US009303506B2

(12) United States Patent
Herrera et al.

(10) Patent No.: US 9,303,506 B2
(45) Date of Patent: Apr. 5, 2016

(54) DRILL STRING TUBULAR WITH A DETECTION SYSTEM MOUNTED THEREIN

(75) Inventors: Adan Hernandez Herrera, Houston, TX (US); James H. Dudley, Spring, TX (US); Michael Dewayne Finke, Cypress, TX (US); Christopher Allen Golla, Kingwood, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 847 days.

(21) Appl. No.: 13/201,343

(22) PCT Filed: Feb. 11, 2010

(86) PCT No.: PCT/US2010/023875

§ 371 (c)(1),
(2), (4) Date: Nov. 14, 2011

(87) PCT Pub. No.: WO2010/093778

PCT Pub. Date: Aug. 19, 2010

(65) Prior Publication Data

US 2012/0055710 A1 Mar. 8, 2012

Related U.S. Application Data

(60) Provisional application No. 61/152,015, filed on Feb. 12, 2009.

(51) Int. Cl.
*E21B 47/01* (2012.01)

(52) U.S. Cl.
CPC ..... *E21B 47/01* (2013.01)

(58) Field of Classification Search
CPC ..... E21B 47/00; E21B 47/01; E21B 47/011; E21B 44/00; E21B 49/00
USPC ..... 166/250.11, 247; 175/41, 40, 26, 27
See application file for complete search history.

(56) References Cited

U.S. PATENT DOCUMENTS

| | | | | |
|---|---|---|---|---|
| 5,251,708 | A | 10/1993 | Perry et al. | |
| 6,672,383 | B2 * | 1/2004 | Holbert et al. | 166/66 |
| 7,172,035 | B2 * | 2/2007 | Michael et al. | 175/19 |
| 7,334,661 | B2 * | 2/2008 | Pabon et al. | 181/108 |
| 7,364,007 | B2 * | 4/2008 | Garcia-Osuna et al. | 181/108 |
| 7,367,392 | B2 * | 5/2008 | Duong et al. | 166/249 |
| 2003/0192689 | A1 * | 10/2003 | Moake et al. | 166/250.01 |
| 2004/0251048 | A1 * | 12/2004 | Kurkoski | 175/41 |
| 2006/0220649 | A1 | 10/2006 | Martinez et al. | |

(Continued)

OTHER PUBLICATIONS

PCT/US2010/023875 International Search Report and Written Opinion, Nov. 29, 2010 (10 p.).

*Primary Examiner* — Jennifer H Gay
*Assistant Examiner* — David Carroll

(57) ABSTRACT

A measurement system for collecting data. The measurement system includes a tubular suspended downhole, the tubular having an outer surface and a flowbore extending therethrough, the flowbore conveying a fluid, a first recess formed in the outer surface of the tubular, a first detection system mounted in the first recess, a second recess formed in the outer surface of the tubular, and a second detection system mounted in the second recess. The second recess is offset relative to the first recess by at least one of an axial distance and a circumferential distance. The first detection system is operable to measure a portion of the data, and the second detection system operable to measure another portion of the data.

19 Claims, 4 Drawing Sheets

(56) References Cited

U.S. PATENT DOCUMENTS

| | | | | |
|---|---|---|---|---|
| 2007/0137896 | A1* | 6/2007 | Villareal et al. | 175/59 |
| 2008/0053707 | A1 | 3/2008 | Martinez et al. | |
| 2008/0202742 | A1* | 8/2008 | Hall et al. | 166/66 |
| 2012/0096935 | A1* | 4/2012 | Finke et al. | 73/152.03 |
| 2013/0014994 | A1* | 1/2013 | Sherrill et al. | 175/58 |
| 2013/0105222 | A1* | 5/2013 | Pate | 175/40 |
| 2013/0277114 | A1* | 10/2013 | Hook et al. | 175/50 |

* cited by examiner

DRILL STRING TUBULAR WITH A DETECTION SYSTEM MOUNTED THEREIN

CROSS-REFERENCE TO RELATED APPLICATIONS

This application is a 35 U.S.C. §371 national stage application of PCT/US2010/023875 filed Feb. 11, 2010, which claims the benefit of U.S. Provisional Patent Application No. 61/152,015 filed Feb. 12, 2009, both of which are incorporated herein by reference in their entireties for all purposes.

STATEMENT REGARDING FEDERALLY SPONSORED RESEARCH OR DEVELOPMENT

Not Applicable.

BACKGROUND

To form an oil or gas well, a bottom hole assembly (BHA), including components such as a motor, steering assembly, one or more drill collars, and a drill bit, are coupled to a length of drill pipe to form a drill string. One or more sensors may be positioned within the drill string for making various downhole measurements. The sensors so positioned may include Geiger-Müller tubes for measuring radiation, including gamma radiation. Once assembled, the drill string is then inserted downhole, where drilling and data collection by the sensors commence.

In some conventional systems, one or more Geiger-Müller tubes are embedded within a chassis, and the chassis is inserted within a drill string tubular. For example, FIG. 1 depicts a conventional system 20, shown in cross-section, having a plurality of Geiger-Müller tubes 22 embedded within a chassis 24. Chassis 24 is inserted into a drill collar 28 and includes a flowbore 26 to permit the passage of drilling fluid therethrough. During operation of system 20, drill collar 28 protects tubes 22 from high pressure loads of drilling fluid passing through flowbore 26 and subsequently returning to the surface through an annulus between drill collar 28 and a surrounding wellbore, as well as mechanical loads from the drill string. A potential drawback to system 20 is that the thickness of drill collar 28 disposed between tubes 22 and radiation surrounding drill collar 28 may degrade the quality of the measurements taken by tubes 22.

Further, in some conventional systems, the Geiger-Müller tubes are spaced azimuthally about only a portion of the chassis, in contrast to system 20 which includes tubes 22 distributed azimuthally about the full circumference of chassis 24. For example, FIG. 2 depicts a conventional system 10, also shown in cross-section, having a plurality of Geiger-Müller tubes 12 embedded within and distributed azimuthally over a limited portion of a chassis 14. Chassis 14 is inserted into a drill collar 18, and includes a flowbore 16 to permit the passage of drilling fluid therethrough. In addition to the potential degradation of measurements taken by tubes 12 due to the thickness of drill collar 18, other potential drawbacks to system 10 include the reduced number of tubes 12, as compared to that of system 20. The reduced number of tubes 12 results in fewer measurements, which, in turn, may yield statistically inconsistent measurements. Additionally, the limited distribution of tubes 12 yields measurements of radiation levels proximate only a portion of drill collar 18, rather than entirely surrounding it. As such, circumferential variations in the radiation level around drill collar 18 may not be detected.

SUMMARY OF THE DISCLOSED EMBODIMENTS

A measurement system for collecting data is disclosed. In some embodiments, the measurement system includes a tubular suspended downhole, the tubular having an outer surface and a flowbore extending therethrough, the flowbore conveying a fluid, a first recess formed in the outer surface of the tubular, a first detection system mounted in the first recess, a second recess formed in the outer surface of the tubular, and a second detection system mounted in the second recess. The second recess is offset relative to the first recess by at least one of an axial distance and a circumferential distance. The first detection system is operable to measure a portion of the data, and the second detection system operable to measure another portion of the data.

In some embodiments, a drill string includes a drill collar having an outer surface and a flowbore extending therethrough, the flowbore conveying a drilling fluid. A first tube bank is formed in the outer surface of the drill collar. A first detection system is mounted in the first tube bank and has an outer surface substantially flush with the outer surface of the drill collar. The first detection system is operable to measure a portion of the data. A second tube bank is also formed in the outer surface of the drill collar. The second tube bank is offset relative to the first tube bank by at least one of an axial distance and a circumferential distance and has an outer surface substantially flush with the outer surface of the drill collar. A second detection system is mounted in the second tube bank and has an outer surface substantially flush with the outer surface of the drill collar. The second detection system is operable to measure another portion of the data. The first and the second detection systems receive power from and transmit the data to components positioned uphole and electrically coupled thereto.

In some embodiments, the measurement system includes a tubular suspended downhole and having an outer surface, a first tube bank formed in the outer surface of the tubular, and a first detection system disposed within the first tube bank. The first detection system includes a plurality of detectors, each detector having a Geiger Muller tube operable to measure radiation, a pressure housing disposed thereabout, and a cover plate coupled to the tubular. The cover plate is moveable between a closed position, wherein the cover plate extends over the first tube bank forming a barrier between the detectors and an annulus formed by the tubular and a formation surrounding the tubular, and an open position, wherein the detectors are accessible.

Thus, embodiments described herein comprise a combination of features and characteristics intended to address various shortcomings associated with certain prior devices. The various characteristics described above, as well as other features, will be readily apparent to those skilled in the art upon reading the following detailed description of the preferred embodiments, and by referring to the accompanying drawings.

BRIEF DESCRIPTION OF THE DRAWINGS

For a more detailed description of the disclosed embodiments, reference will now be made to the accompanying drawings, wherein.

DETAILED DESCRIPTION OF THE DISCLOSED EMBODIMENTS

Figure 3:
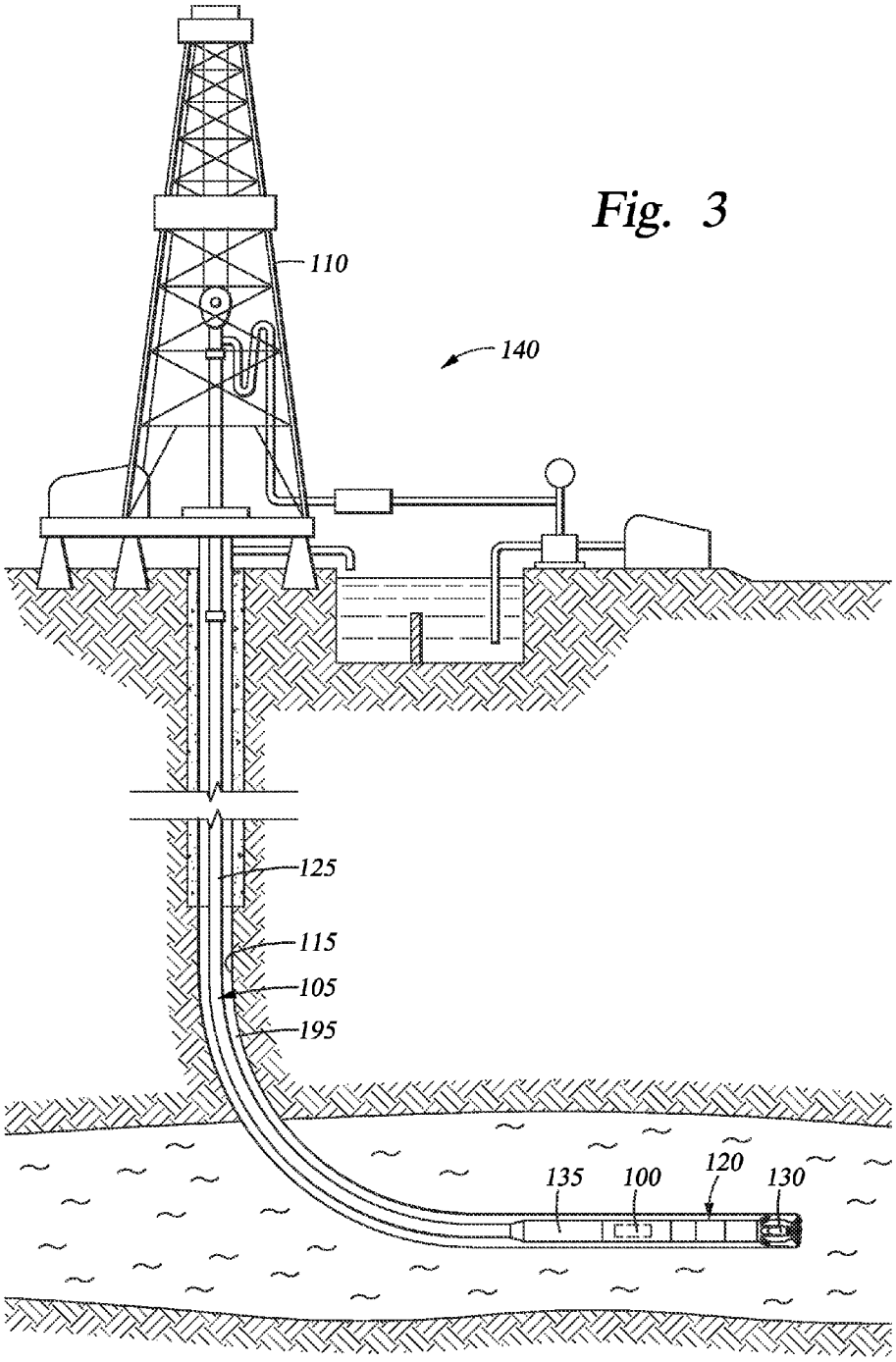
FIG. 3 is a schematic representation of a drilling system including a detection system in accordance with the principles disclosed herein.

Referring now to FIG. 3, a drilling system 140 including one or more detection systems 100 in accordance with the principles disclosed herein is depicted. Drilling system 140 further includes a drill string 105 suspended from a rig 110 into a wellbore 115. Drill string 105 includes a plurality of drill pipe sections 125, coupled end-to-end, to which a BHA 120 is coupled. BHA 120 includes a drill bit 130 and a drill collar 135 within which detection systems 100 are disposed. Drill collar 135 is a thick-walled tubular which provides weight on drill bit 130 for drilling. BHA 120 may include other components, such as but not limited to a drill sub, a motor, steering assembly, and additional drill collars. During drilling, drilling fluid, or "drilling mud," is circulated down through drill string 105 to lubricate and cool drill bit 130 as well as to provide a vehicle for removal of drill cuttings from wellbore 115. After exiting drill bit 130, the drilling fluid returns to the surface through an annulus 195 between drill string 105 and wellbore 115.

In this embodiment, rig 110 is land-based. In other embodiments, detection systems 100 may be positioned within a drill string suspended from a rig on a floating platform. Furthermore, detection systems 100 need not be disposed in a drill string, but may also be positioned within a downhole tubular suspended by wireline, coiled tubing, or other similar device, as opposed to a drill string, as illustrated by this embodiment.

Figure 4:
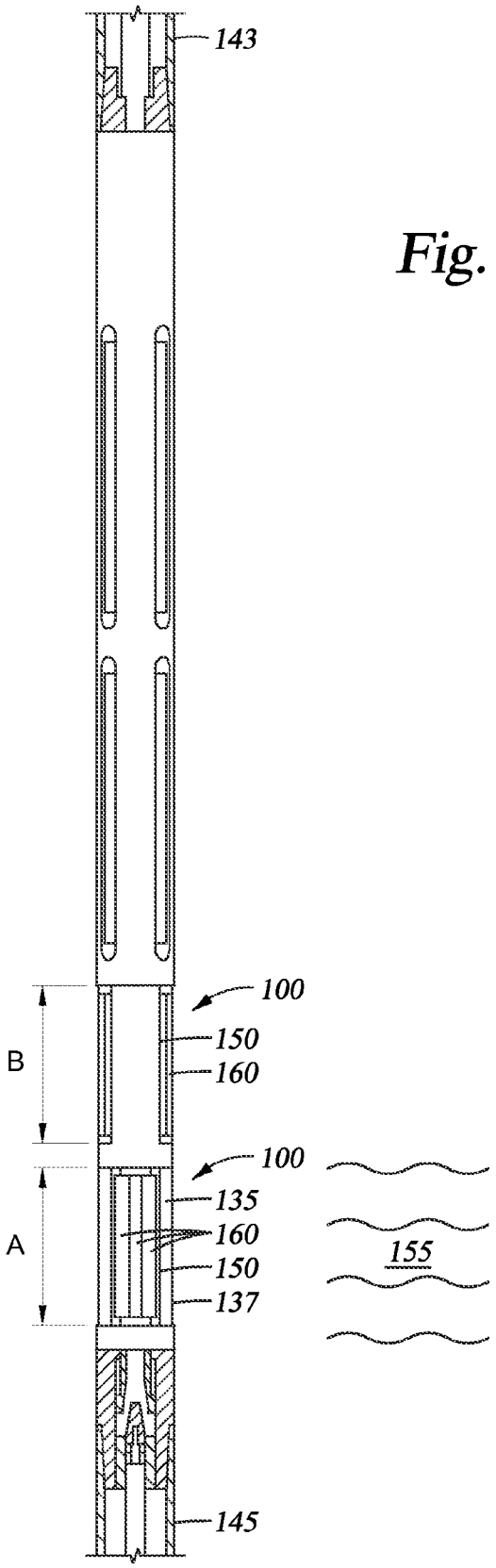
FIG. 4 is a side view of the drill collar of FIG. 3 with the detection systems mounted therein.

Referring next to FIG. 4, an enlarged view of drill collar 135 with detection systems 100 disposed therein is shown. Drill collar 135 is structurally and fluidicly coupled between two adjacent components 143, 145 of drill string 105 positioned uphole and downhole, respectively, of drill collar 135. In some embodiments, component 143 is a section of drill pipe 125, and component 145 is another component of BHA 120, such as a stabilizer. Moreover, detection systems 100 are electrically coupled to components 143, 145 to enable transmission of power from a source positioned on drill string 105 and/or the surface to detection systems 100, and transmission of measurements collected by detection systems 100 to the surface and/or a data storage device positioned on drill string 105.

Figure 1:
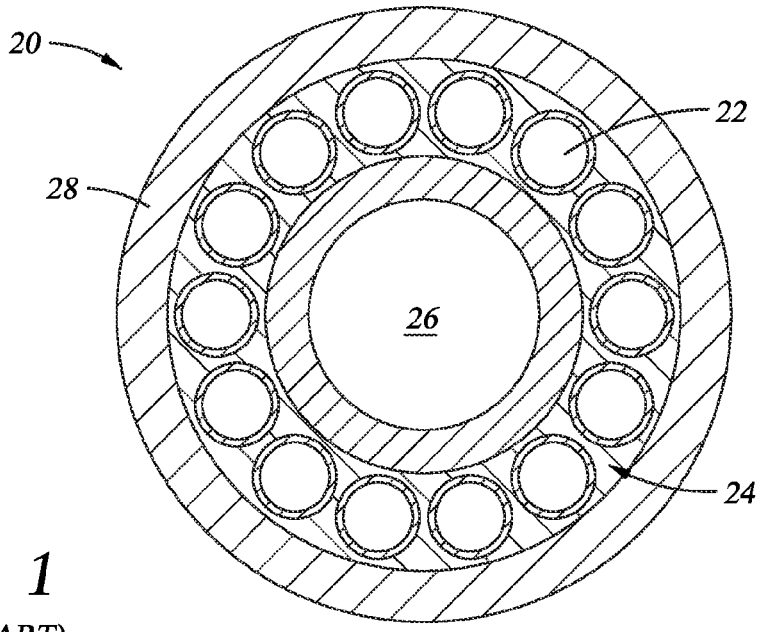
Fig. 1 (PRIOR ART)
FIG. 1 is a cross-sectional view of a conventional system including a plurality of Geiger-Müller tubes distributed azimuthally within a chassis inserted within a drill collar.
Figure 2:
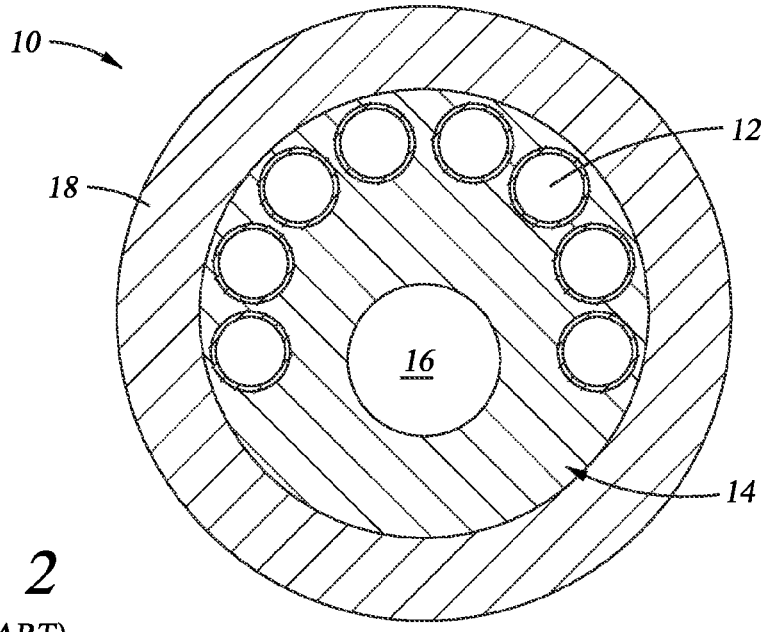
Fig. 2 (PRIOR ART)
FIG. 2 is a cross-sectional view of another conventional system including a plurality of Geiger-Müller tubes distributed azimuthally within a portion of a chassis inserted within a drill collar.

Drill collar 135 includes one or more tube banks 150 positioned circumferentially thereabout, some of which may be axially offset relative to the others. A detection system 100 is mounted within each tube bank 150. In contrast to conventional Geiger Müller detection systems, including those illustrated by FIGS. 1 and 2, each detection system 100 is mounted within and coupled directly to drill collar 135 without the need for an insert positioned therebetween to act as a chassis for the detection system 100. Instead, drill collar 135 acts as a chassis to which detection systems 100 are coupled. One of ordinary skill in the art will readily appreciate that detection systems 100 may be similarly positioned within and coupled to another tubular in drill string 105, instead of drill collar 135. In such cases, the tubular acts as a chassis for detection systems 100.

Tube banks 150 are recesses formed in drill collar 135 and are each configured to receive a detection system 100 such that detection system 100 is positioned proximate the outer surface 137 of drill collar 135. This enables detection system 100 to be positioned close to radiation 155 which may surround drill collar 135 without any portion of drill collar 135 disposed therebetween. Thus, radiation measurements taken by detection systems 100 will not be degraded due to the presence of drill collar 135 material between detection systems 100 and radiation 155.

Each detector system 100 includes one or more detectors 160 mounted within its respective tube bank 150, as will be described in more detail below. Hence, each tube bank 150 is configured to receive a number of detectors 160, and may be sized to receive a different number of detectors 160 than other tube banks 150. For example, as shown in FIG. 4, there are three detectors 160 mounted within the tube bank 150. Further, each tube bank 150 extends longitudinally, or axially, along drill collar 135. In some embodiments, however, one or more of tube banks 150 may extend in other directions along drill collar 135. Additionally, tube banks 150 may be distributed azimuthally, or circumferentially, about drill collar 135. This enables the collection of measurements around the entire periphery of drill collar 135, rather than just a portion of it.

Further, some of tube banks 150 may be staggered axially relative to the remaining tube banks 150. Staggering tube banks 150 axially along the length of drill collar 135 reduces the amount of material removed from any portion of drill collar 135 to create tube banks 150, as compared to the amount of material which would be removed from the same portion of drill collar 135 to create axially aligned tube banks 150. For example, portion A of drill collar 135 includes one tube bank 150, while portion B of drill collar 135 includes two tube banks 150 staggered axially from the one in portion A. If all three tube banks 150 were axially aligned within portion A, more material would be removed from portion A to create two additional tube banks 150. The greater the volume of material removed from a cross-section of drill collar 135, the lower the resistance of drill collar 135 at the cross-section to loading. Thus, by staggering some tube banks 150 relative to others, the amount of material removed through any given cross-section of drill collar 135 is minimized. As a result, the structural capacity of drill collar 135 is maximized, thereby allowing drill collar 135 to resist axial, torsional, and pressure loads caused by drilling operations.

Furthermore, the combination of staggering detector systems 100 axially along drill collar 135 and disposing detector systems 100 circumferentially about the entire periphery of drill collar 135 enables positioning an increased number of detector systems within drill collar 135 than would otherwise be possible. In turn, the increased number of system 100 enables the collection of more measurements or data to provide a statistically accurate representation of radiation levels surrounding drill collar 135.

Figure 5:
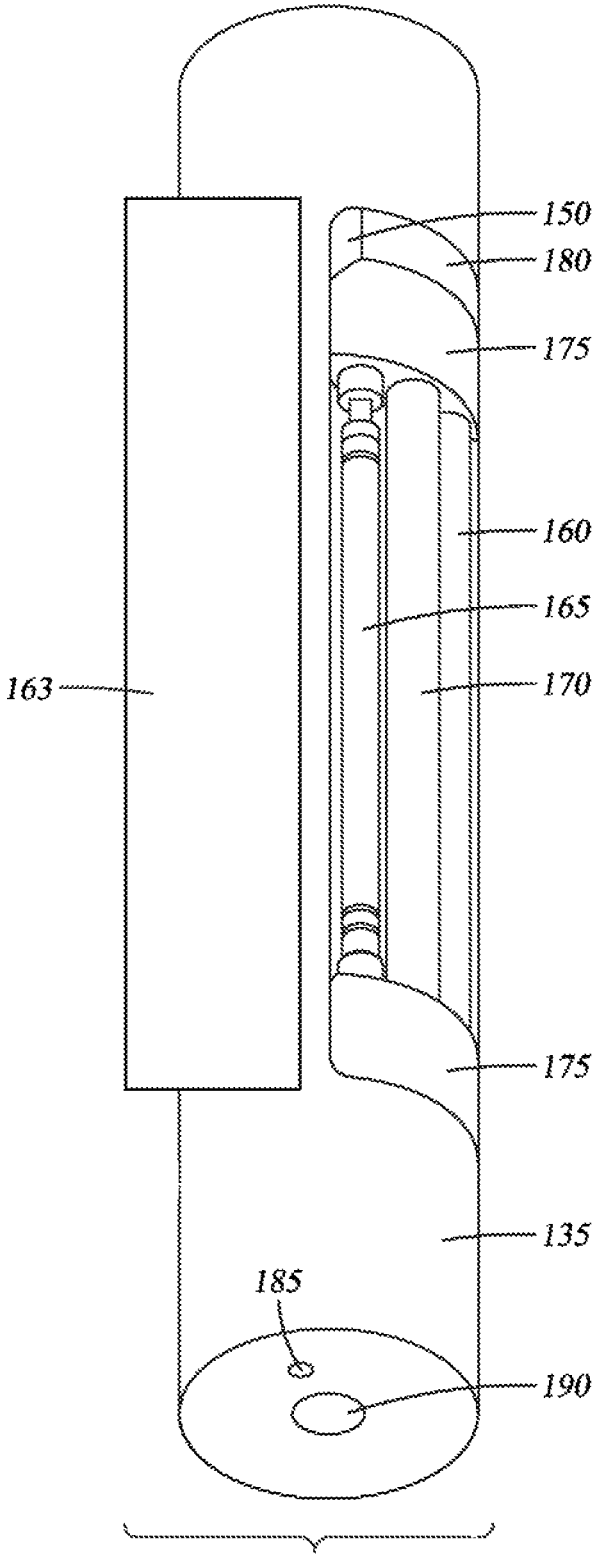
FIG. 5 is an exploded perspective view of a single tube bank within the drill collar of FIG. 4.

Referring next to FIG. 5, detectors 160 are coupled at both ends to drill collar 135 by an endcap 175 and a spool 180. In turn, end cap 175 and spool 180 are secured to drill collar 135 by mechanical means, such as but not limited to seal bolts and locking pins (not shown). A cover plate 163 is coupled to drill collar 135 over tube bank 150 to enclose detectors 160. Cover plate 163 is durable such that it protects detectors 160 from abrasion and impact loads. Cover plate 163 is also thin, thus any potential interference to data collection is negligible. Further cover plate 163 is also removable to expose detectors 160 as needed. Each detector 160 is also electrically coupled to other electronics (not shown) disposed within drill collar 135 to enable data measurement and transmission, as previously described. Drill collar 135 further includes a bore 185 to receive electrical wiring necessary for the data and power transmission, and a flowbore 190 to allow the passage of drilling fluid therethrough.

Each detector 160 includes a Geiger Müller tube 165 disposed within a pressure housing 170. For the purposes of illustration, one of the three detectors 160 depicted in FIG. 5 is shown without its pressure housing 170 to expose its Geiger Müller tube 165. Each pressure housing 170 is configured to withstand pressure loads of drilling fluid passing through an annulus 195 (FIG. 3) between drill collar 135 and the surrounding wellbore 115, and to protect the Geiger Müller tube 165 disposed therein. As is known in the art, each Geiger Müller tube 165 is configured to measure surrounding radiation, including gamma radiation.

To assemble drill string 105 (FIG. 3), detection systems 100 are initially mounted within tube banks 150 of drill collar 135 via end cap 175 and spool 180. Also, each detector 160 is electrically coupled to other electronics disposed within drill collar 135 to enable data measurement and transmission, as previously described. Cover plate 163 is then positioned over each tube bank 150 to protect detectors 160 positioned therein. Electrical wiring is extended from the electronics through bore 185 of drill collar 135 to enable transmission of power to detector systems 100 and of data from detector systems 100. Once detector systems 100 are fully assembled within drill collar 135, drill collar 135 is positioned within drill string 105. When drill string 105 is fully assembled, drill string 105 is suspended from rig 110 and used to create wellbore 115.

During drilling operations, drilling fluid is delivered through drill string 105, including flowbore 190 of drill collar 135, to drill bit 130. Upon exiting drill bit 130, the drilling fluid returns to the surface via annulus 195 between drill string 105 and wellbore 115. As drilling operations progress, detection systems 100 may be actuated to collect radiation measurements and transmit collected data to the surface and/or a storage device positioned on drill string 105.

The disclosed embodiment is directed to a detector system 100 including a Geiger Müller tube 165 for taking radiation measurements downhole. As described, positioning tube 165 proximate to surrounding radiation 155 without a tubular component, such as drill collar 135, disposed between tube 165 and radiation 155 enables improved measurement quality. Moreover, positioning a plurality of such detectors 160 circumferentially about the tubular component, some of which axially offset relative to the others, allows data collection using a number of detectors 160, thereby generating a statistically consistent representation of the radiation levels surrounding the tubular, with minimal impact to the structural integrity of the tubular. One of ordinary skill in the art will readily appreciate that similar positioning other types of sensors may also be desirable for at least the same reasons. Thus, the disclosed embodiment is not limited to detector systems 100 including Geiger Müller tubes 165. In alternative embodiments, detector systems 100 may include another type(s) of sensor in place of or in addition to Geiger Müller tubes 165.

While the preferred embodiment of this invention has been shown and described, modifications thereof can be made by one skilled in the art without departing from the scope or teaching of this invention. The embodiments described herein are exemplary only and are not limiting. Many variations and modifications of the system and apparatus are possible and are within the scope of the invention. For example, the relative dimensions of various parts, the materials from which the various parts are made, and other parameters can be varied, so long as the methods and apparatus retain the advantages discussed herein. Accordingly, the scope of protection is not limited to the embodiments described herein, but is only limited by the claims that follow, the scope of which shall include all equivalents of the subject matter of the claims.

What is claimed is:

1. A measurement system for collecting data, the measurement system comprising:
- a tubular suspended downhole, the tubular comprising an outer surface and a flowbore extending therethrough, the flowbore conveying a fluid;
- a first recess formed in the outer surface of the tubular;
- a first detection system mounted in the first recess, the first detection system operable to measure a portion of the data and including a pressure housing configured to withstand pressure loads of drilling fluids in drilling operations;
- a second recess formed in the outer surface of the tubular, the second recess offset relative to the first recess by at least one of an axial distance and a circumferential distance; and
- a second detection system mounted in the second recess, the second detection system including a pressure housing and operable to measure another portion of the data,
- wherein the first detection system includes a plurality of pressure housings circumferentially distributed along the first recess, each pressure housing of the plurality of pressure housings including a detector therein that is operable to measure a portion of the data.

2. The measurement system of claim 1, wherein the tubular is a drill collar and wherein the fluid is a drilling fluid.

3. The measurement system of claim 1, wherein the data is radiation measurements.

4. The measurement system of claim 1, wherein the second recess is axially offset and circumferentially offset relative to the first recess.

5. The measurement system of claim 1, wherein the first detection system and the second detection system are electrically coupled with components positioned uphole therefrom, the first detection system and the second detection system receiving power from one of the components and transmitting the data to another of the components.

6. The measurement system of claim 1, wherein each of the first detection system and the second detection system comprises:
- a plurality of detectors, each detector comprising:
  - a Geiger Muller tube operable to measure radiation;
  - wherein the pressure housing is disposed thereabout.

7. The measurement system of claim 6, wherein each of the first detection system and the second detection system further comprises: a cover plate coupled to the tubular, the cover plate moveable between a closed position, wherein the cover plate forms a barrier between the detectors and an annulus formed by the tubular and a formation surrounding the tubular, and an open position, wherein the detectors are accessible.

8. The measurement system of claim 7, wherein an outer surface of the cover plate is substantially flush with the outer surface of the tubular.

9. A drill string comprising:
- a drill collar comprising an outer surface and a flowbore extending therethrough, the flowbore conveying a drilling fluid;
- a first tube bank formed in the outer surface of the drill collar;

a first detection system mounted in the first tube bank including a pressure housing configured to withstand pressure loads of drilling fluids in drilling operations and comprising an outer surface substantially flush with the outer surface of the drill collar, the first detection system operable to measure a portion of the data;

a second tube bank formed in the outer surface of the drill collar, the second tube bank offset relative to the first tube bank by at least one of an axial distance and a circumferential distance and comprising an outer surface substantially flush with the outer surface of the drill collar; and a second detection system mounted in the second tube bank including a pressure housing and comprising an outer surface substantially flush with the outer surface of the drill collar, the second detection system operable to measure another portion of the data; and wherein the first and the second detection systems receive power from and transmit the data to components positioned uphole and electrically coupled thereto, wherein the first detection system includes a plurality of pressure housings circumferentially distributed along the first tube bank, each pressure housing of the plurality of pressure housings including a detector therein that is operable to measure a portion of the data.

10. The drill string of claim 9, wherein the data is radiation measurements.

11. The drill string of claim 9, wherein the second tube bank is axially offset and circumferentially offset relative to the first tube bank.

12. The drill string of claim 9, wherein each of the first detection system and the second detection system comprises:

a plurality of detectors, each detector comprising:

a Geiger Muller tube operable to measure radiation;

wherein the pressure housing is disposed thereabout.

13. The drill string of claim 12, wherein each of the first detection system and the second detection system further comprises:

a cover plate moveable between a closed position, wherein the cover plate forms a barrier between the detectors and an annulus formed by the drill collar and a formation surrounding the drill collar, and an open position, wherein the detectors are accessible; and wherein an outer surface of the cover plate is substantially flush with the outer surface of the drill collar.

14. A measurement system comprising:

a tubular suspended downhole and comprising an outer surface;

a first tube bank formed in the outer surface of the tubular; and a first detection system disposed within the first tube bank, the first detection system comprising:

a plurality of detectors circumferentially distributed along the first tube bank, each detector comprising:

a Geiger Muller tube operable to measure radiation; and a pressure housing disposed thereabout, the pressure housing configured to withstand pressure loads of drilling fluids in drilling operations; and a cover plate coupled to the tubular, the cover plate moveable between a closed position, wherein the cover plate extends over the first tube bank forming a barrier between the circumferentially distributed detectors and an annulus formed by the tubular and a formation surrounding the tubular, and an open position, wherein the circumferentially distributed detectors are accessible.

15. The measurement system of claim 14, wherein the Geiger Muller tubes extend axially within the first tube bank relative to the tubular.

16. The measurement system of claim 14, wherein an outer surface of the cover plate is substantially flush with the outer surface of the tubular.

17. The measurement system of claim 14, wherein the tubular further comprises an axial extending bore through which electrical wiring extends, the electrical wiring coupled between the Geiger Muller tubes and components uphole therefrom and operable to deliver power to the Geiger Muller tubes and to transmit data from the Geiger Muller tubes.

18. The measurement system of claim 14, further comprising:

a second tube bank formed in the outer surface of the tubular, the second tube bank offset relative to the first tube bank by at least one of an axial distance and a circumferential distance; and a second detection system disposed within the second tube bank, the second detection system substantially identical to the first detection system.

19. The measurement system of claim 1, wherein each pressure housing of the plurality of pressure housings is coupled to and circumferentially distributed along an endcap disposed within the first recess.

* * * * *